US006544707B2

(12) United States Patent
Nakamura et al.

(10) Patent No.: US 6,544,707 B2
(45) Date of Patent: Apr. 8, 2003

(54) TWO COMPONENT DEVELOPING AGENT AND AN IMAGE FORMING APPARATUS BY USE OF THE SAME

(75) Inventors: Yasushige Nakamura, Kawasaki (JP); Seijiro Ishimaru, Kawasaki (JP); Yoshimichi Katagiri, Kawasaki (JP); Yuji Sato, Kashiwa (JP); Tsuyoshi Itagoshi, Kashiwa (JP); Hiromichi Kobayashi, Kashiwa (JP)

(73) Assignees: Fujitsu Limited, Kawasaki (JP); Powdertech Co., Ltd., Kashiwa (JP)

( * ) Notice: Subject to any disclaimer, the term of this patent is extended or adjusted under 35 U.S.C. 154(b) by 0 days.

(21) Appl. No.: 09/768,290

(22) Filed: Jan. 25, 2001

(65) Prior Publication Data

US 2002/0064724 A1 May 30, 2002

(30) Foreign Application Priority Data

Jul. 7, 2000 (JP) ..... 2000-207557

(51) Int. Cl.[7] ..... G03G 9/13

(52) U.S. Cl. ..... 430/111.33; 430/111.1; 430/111.35; 399/252; 399/336

(58) Field of Search ..... 430/137.13, 111.1, 430/111.31, 111.32, 111.33, 111.35; 399/252, 336

(56) References Cited

U.S. PATENT DOCUMENTS

| | | | | |
|---|---|---|---|---|
| 2,297,691 A | | 10/1942 | Carlson | 430/55 |
| 4,485,162 A | * | 11/1984 | Imamura et al. | 430/111.31 |
| 4,562,136 A | * | 12/1985 | Inoue et al. | 430/111.1 |
| 5,567,561 A | * | 10/1996 | Yoshikawa et al. | 430/111.2 |
| 5,672,455 A | * | 9/1997 | Yanagida et al. | 430/111.1 |
| 5,986,017 A | * | 11/1999 | Katagiri et al. | 430/109.4 |
| 6,124,066 A | * | 9/2000 | Kim et al. | 430/111.33 |

FOREIGN PATENT DOCUMENTS

| | | |
|---|---|---|
| JP | 57-96355 | 6/1982 |
| JP | 58-184951 | * 10/1983 |
| JP | 64-29856 | 1/1989 |
| JP | 4-188162 | 7/1992 |
| JP | 7-72668 | 3/1995 |
| JP | 10-20562 | 1/1998 |

OTHER PUBLICATIONS

Japanese Patent Office English–Language Abstract describing JP 58–184951 (pub Oct. 1983).*

Derwent Abstract Acc. No. 1983–835842 describing JP 58–184951, 1983.*

* cited by examiner

*Primary Examiner*—Janis L. Dote

(74) *Attorney, Agent, or Firm*—Armstrong, Westerman & Hattori, LLP

(57) ABSTRACT

There is disclosed a two-component developing agent for use in an mage formation based on electrophotography, which has high developability even at a high speed printing and good developability in the case of the image formation for a long period of time. The two-component developing agent includes a carrier comprising a magnetic particle and an insulating toner. A surface of the magnetic particle is coated with at least a resin. A mean particle size of the magnetic particle is between 30 and 90 $\mu$m and an aggregation degree of said carrier is between 2 and 15%.

13 Claims, 9 Drawing Sheets

FIG.1A

| | PRINTING RATE | DEVELOPING AGENT | | MAGNETIC PARTICLE | | COATING MATERIAL | CONDUCTIVE CARBON | | | |
|---|---|---|---|---|---|---|---|---|---|---|
| | (mm/s) | TONER No. | CARRIER No. | KIND | CONTENT OF MnO (mol%) | | ADDITION AMOUNT IN INNER LAYER (%) | CARBON GRADIENT | ADDITION AMOUNT IN SURFACE LAYER (%) | SPECIFIC SURFACE AREA ($m^2/g$) |
| EXAMPLE 1 | 1152 | 1 | 1 | Mn-FERRITE | 20 | FLUORINE-MODIFIED SILICONE | 15.0 | ABSENCE | 15.0 | 1270 |
| EXAMPLE 2 | 1152 | 1 | 2 | Mn-FERRITE | 20 | FLUORINE-MODIFIED SILICONE | 15.0 | ABSENCE | 15.0 | 1270 |
| EXAMPLE 3 | 1152 | 1 | 3 | Mn-FERRITE | 20 | FLUORINE-MODIFIED SILICONE | 15.0 | ABSENCE | 15.0 | 1270 |
| EXAMPLE 4 | 1152 | 1 | 4 | Mn-FERRITE | 20 | FLUORINE-MODIFIED SILICONE | 15.0 | ABSENCE | 15.0 | 1270 |
| EXAMPLE 5 | 1152 | 1 | 5 | Mn-FERRITE | 20 | FLUORINE-MODIFIED SILICONE | 15.0 | ABSENCE | 15.0 | 1270 |
| EXAMPLE 6 | 1152 | 1 | 6 | Mn-FERRITE | 20 | FLUORINE-MODIFIED SILICONE | 15.0 | ABSENCE | 15.0 | 1270 |
| EXAMPLE 7 | 1152 | 1 | 7 | Mn-FERRITE | 20 | FLUORINE-MODIFIED SILICONE | 15.0 | ABSENCE | 15.0 | 1270 |
| EXAMPLE 8 | 1152 | 1 | 8 | Mn-FERRITE | 20 | FLUORINE-MODIFIED SILICONE | 15.0 | ABSENCE | 15.0 | 1270 |
| EXAMPLE 9 | 1152 | 1 | 9 | Mn-FERRITE | 20 | FLUORINE-MODIFIED SILICONE | 15.0 | ABSENCE | 15.0 | 1270 |
| EXAMPLE 10 | 1152 | 1 | 10 | Mn-FERRITE | 20 | FLUORINE-MODIFIED SILICONE | 15.0 | ABSENCE | 15.0 | 1270 |
| EXAMPLE 11 | 1152 | 1 | 11 | Mn-FERRITE | 20 | FLUORINE-MODIFIED SILICONE | 15.0 | ABSENCE | 15.0 | 1270 |
| EXAMPLE 12 | 1152 | 1 | 12 | Mn-FERRITE | 20 | FLUORINE-MODIFIED SILICONE | 15.0 | ABSENCE | 15.0 | 1270 |
| EXAMPLE 13 | 1152 | 1 | 13 | Mn-FERRITE | 20 | FLUORINE-MODIFIED SILICONE | 15.0 | ABSENCE | 15.0 | 1270 |
| EXAMPLE 14 | 1152 | 1 | 14 | Mn-FERRITE | 20 | FLUORINE-MODIFIED SILICONE | 15.0 | ABSENCE | 15.0 | 1270 |
| COMPARATIVE EXAMPLE 1 | 1152 | 1 | 15 | Mn-FERRITE | 20 | FLUORINE-MODIFIED SILICONE | 15.0 | ABSENCE | 15.0 | 1270 |
| COMPARATIVE EXAMPLE 2 | 1152 | 1 | 16 | Mn-FERRITE | 20 | FLUORINE-MODIFIED SILICONE | 15.0 | ABSENCE | 15.0 | 1270 |

FIG.1B

| | COATING AMOUNT (wt%) (RELATIVE TO MAGNETIC PARTICLE) | COATING HOUR (H) | CURE TEMPERATURE (℃) | CURE TIME (H) | POST-TREATMENT HOUR (M) | MEAN PARTICLE SIZE OF COATING CARRIER (μm) | MEAN PARTICLE SIZE OF MAGNETIC PARTICLE (μm) |
|---|---|---|---|---|---|---|---|
| EXAMPLE 1 | 2.0 | 1.0 | 270 | 1 | 30 | 80.8 | 75.1 |
| EXAMPLE 2 | 2.0 | 1.0 | 270 | 1 | 3 | 85.8 | 75.1 |
| EXAMPLE 3 | 2.0 | 1.0 | 270 | 1 | 120 | 77.5 | 75.8 |
| EXAMPLE 4 | 2.0 | 0.7 | 270 | 1 | 30 | 83.3 | 75.0 |
| EXAMPLE 5 | 2.0 | 1.5 | 270 | 1 | 30 | 78.1 | 75.2 |
| EXAMPLE 6 | 2.0 | 1.0 | 270 | 0.5 | 30 | 81.9 | 75.4 |
| EXAMPLE 7 | 2.0 | 1.0 | 300 | 5 | 30 | 80.7 | 74.3 |
| EXAMPLE 8 | 2.0 | 1.0 | 220 | 0.1 | 30 | 81.2 | 76.4 |
| EXAMPLE 9 | 1.7 | 1.0 | 270 | 1 | 30 | 80.9 | 76.3 |
| EXAMPLE 10 | 2.3 | 1.0 | 270 | 1 | 30 | 83.9 | 76.6 |
| EXAMPLE 11 | 2.0 | 0.5 | 270 | 1 | 30 | 86.4 | 76.5 |
| EXAMPLE 12 | 2.0 | 10.0 | 270 | 1 | 30 | 81.6 | 75.2 |
| EXAMPLE 13 | 2.0 | 0.5 | 270 | 0.1 | 30 | 85.1 | 75.3 |
| EXAMPLE 14 | 2.0 | 0.5 | 270 | 5 | 30 | 83.3 | 74.1 |
| COMPARATIVE EXAMPLE 1 | 1.0 | 0.2 | 300 | 5 | 120 | 75.2 | 74.7 |
| COMPARATIVE EXAMPLE 2 | 1.5 | 0.2 | 220 | 0.05 | 0.3 | 95.8 | 75.8 |

FIG.1C

| | PRINTING RATE | DEVELOPING AGENT | | MAGNETIC PARTICLE | | COATING MATERIAL | CONDUCTIVE CARBON | | | |
|---|---|---|---|---|---|---|---|---|---|---|
| | (mm/s) | TONER No. | CARRIER No. | KIND | CONTENT OF MnO (mol%) | | ADDITION AMOUNT IN INNER LAYER (%) | CARBON GRADIENT | ADDITION AMOUNT IN SURFACE LAYER (%) | SPECIFIC SURFACE AREA ($m^2/g$) |
| EXAMPLE 15 | 1152 | 1 | 17 | Mn-FERRITE | 20 | FLUORINE-MODIFIED SILICONE | 15.0 | ABSENCE | 15.0 | 800 |
| EXAMPLE 16 | 1152 | 1 | 18 | Mn-FERRITE | 20 | FLUORINE-MODIFIED SILICONE | 15.0 | ABSENCE | 15.0 | 639 |
| EXAMPLE 17 | 1152 | 1 | 19 | Mn-FERRITE | 20 | FLUORINE-MODIFIED SILICONE | 15.0 | PRESECE | 17.5 | 1270 |
| EXAMPLE 18 | 1152 | 1 | 20 | Mn-FERRITE | 20 | FLUORINE-MODIFIED SILICONE | 15.0 | PRESECE | 17.5 | 1270 |
| EXAMPLE 19 | 1152 | 1 | 21 | Mn-FERRITE | 20 | FLUORINE-MODIFIED SILICONE | 15.0 | PRESECE | 2.0 | 1270 |
| EXAMPLE 20 | 1152 | 1 | 22 | Mn-FERRITE | 5 | FLUORINE-MODIFIED SILICONE | 15.0 | ABSENCE | 15.0 | 1270 |
| EXAMPLE 21 | 1152 | 1 | 23 | Mn-FERRITE | 10 | FLUORINE-MODIFIED SILICONE | 15.0 | ABSENCE | 15.0 | 1270 |
| EXAMPLE 22 | 1152 | 1 | 24 | Mn-FERRITE | 20 | FLUORINE-MODIFIED SILICONE | 15.0 | ABSENCE | 15.0 | 1270 |
| EXAMPLE 23 | 1152 | 1 | 25 | Mn-FERRITE | 40 | FLUORINE-MODIFIED SILICONE | 15.0 | ABSENCE | 15.0 | 1270 |
| EXAMPLE 24 | 1152 | 1 | 26 | Mn-FERRITE | 55 | FLUORINE-MODIFIED SILICONE | 15.0 | ABSENCE | 15.0 | 1270 |
| EXAMPLE 25 | 1152 | 1 | 27 | Mn-FERRITE | 20 | STRAIGHT SILICONE | 15.0 | ABSENCE | 15.0 | 1270 |
| EXAMPLE 26 | 1152 | 1 | 28 | Mn-FERRITE | 20 | ACRYLIC-MODIFIED SILICONE | 15.0 | ABSENCE | 15.0 | 1270 |
| EXAMPLE 27 | 1152 | 1 | 29 | Mn-FERRITE | 0 | FLUORINE-MODIFIED SILICONE | 15.0 | ABSENCE | 15.0 | 1270 |
| EXAMPLE 28 | 1152 | 2 | 2 | Mn-FERRITE | 20 | FLUORINE-MODIFIED SILICONE | 15.0 | ABSENCE | 15.0 | 1270 |
| EXAMPLE 29 | 1152 | 3 | 2 | Mn-FERRITE | 20 | FLUORINE-MODIFIED SILICONE | 15.0 | ABSENCE | 15.0 | 1270 |
| EXAMPLE 30 | 1152 | 4 | 2 | Mn-FERRITE | 20 | FLUORINE-MODIFIED SILICONE | 15.0 | ABSENCE | 15.0 | 1270 |
| EXAMPLE 31 | 800 | 1 | 11 | Mn-FERRITE | 20 | FLUORINE-MODIFIED SILICONE | 15.0 | ABSENCE | 15.0 | 1270 |
| EXAMPLE 32 | 500 | 1 | 11 | Mn-FERRITE | 20 | FLUORINE-MODIFIED SILICONE | 15.0 | ABSENCE | 15.0 | 1270 |
| COMPARATIVE EXAMPLE 3 | 1152 | DEVELOPING AGENT AVAILABLE COMMERCIALLY FROM A COMPANY | | | | (USE OF CARRIER COATED WITH SILICONE RESIN) | | | | |
| COMPARATIVE EXAMPLE 4 | 1152 | DEVELOPING AGENT AVAILABLE COMMERCIALLY FROM B COMPANY | | | | (USE OF CARRIER COATED WITH SILICONE RESIN) | | | | |

FIG.1D

| | COATING AMOUNT (wt%) (RELATIVE TO MAGNETIC PARTICLE) | COATING HOUR (H) | CURE TEMPERATURE (°C) | CURE TIME (H) | POST-TREATMENT HOUR (M) | MEAN PARTICLE SIZE OF COATING CARRIER (μm) | MEAN PARTICLE SIZE OF MAGNETIC PARTICLE (μm) |
|---|---|---|---|---|---|---|---|
| EXAMPLE 15 | 2.0 | 1.0 | 300 | 5 | 30 | 83.1 | 75.0 |
| EXAMPLE 16 | 2.0 | 1.0 | 300 | 5 | 30 | 85.0 | 75.8 |
| EXAMPLE 17 | 2.0 | 1.0 | 270 | 1 | 30 | 81.6 | 76.2 |
| EXAMPLE 18 | 2.0 | 1.0 | 300 | 5 | 30 | 81.6 | 76.2 |
| EXAMPLE 19 | 2.0 | 1.0 | 300 | 5 | 30 | 83.5 | 75.0 |
| EXAMPLE 20 | 1.5 | 0.5 | 270 | 1 | 30 | 83.3 | 76.2 |
| EXAMPLE 21 | 1.5 | 0.5 | 270 | 1 | 30 | 81.3 | 75.1 |
| EXAMPLE 22 | 1.5 | 0.5 | 270 | 1 | 30 | 82.6 | 76.3 |
| EXAMPLE 23 | 1.5 | 0.5 | 270 | 1 | 30 | 81.7 | 75.8 |
| EXAMPLE 24 | 1.5 | 0.5 | 270 | 1 | 30 | 81.2 | 75.8 |
| EXAMPLE 25 | 1.5 | 0.5 | 270 | 1 | 30 | 82.7 | 76.2 |
| EXAMPLE 26 | 1.5 | 0.5 | 270 | 1 | 30 | 86.2 | 75.1 |
| EXAMPLE 27 | 1.5 | 0.5 | 270 | 1 | 30 | 81.5 | 75.2 |
| EXAMPLE 28 | 2.0 | 1.0 | 270 | 1 | 3 | 85.9 | 75.1 |
| EXAMPLE 29 | 2.0 | 1.0 | 270 | 1 | 3 | 85.9 | 75.1 |
| EXAMPLE 30 | 2.0 | 1.0 | 270 | 1 | 3 | 85.9 | 75.1 |
| EXAMPLE 31 | 2.0 | 0.5 | 270 | 1 | 30 | 86.4 | 76.5 |
| EXAMPLE 32 | 2.0 | 0.5 | 270 | 1 | 30 | 86.4 | 76.5 |
| COMPARATIVE EXAMPLE 3 | DEVELOPING AGENT AVAILABLE COMMERCIALLY FROM A COMPANY (USE OF CARRIER COATED WITH SILICONE RESIN) | | | | | 92.4 | 77.2 |
| COMPARATIVE EXAMPLE 4 | DEVELOPING AGENT AVAILABLE COMMERCIALLY FROM B COMPANY (USE OF CARRIER COATED WITH SILICONE RESIN) | | | | | 75.0 | 75.6 |

FIG.2A

| | PRINTING RATE | DEVELOPING AGENT | | AGGREGATION DEGREE | SOLUBLE AMOUNT IN CHLOROFORM | COVERAGE | EXCESSIVE CHARGING OF TONER CHARGE | | |
|---|---|---|---|---|---|---|---|---|---|
| | | | | | | | CHARGING AMOUNT (μC/g) | | JUDGEMENT |
| | (mm/s) | TONER No. | CARRIER No. | (%) | (%) | (%) | INITIAL | AFTER 1,000,000 PRINTS | |
| EXAMPLE 1 | 1152 | 1 | 1 | 7.6 | 6.1 | 85.5 | 20.1 | 21.6 | ◎ |
| EXAMPLE 2 | 1152 | 1 | 2 | 14.4 | 6.8 | 91.3 | 20.6 | 25.2 | ○ |
| EXAMPLE 3 | 1152 | 1 | 3 | 2.2 | 5.7 | 87.2 | 20.5 | 20.9 | ◎ |
| EXAMPLE 4 | 1152 | 1 | 4 | 11.1 | 7.0 | 81.5 | 19.8 | 23.3 | ○ |
| EXAMPLE 5 | 1152 | 1 | 5 | 3.9 | 6.3 | 93.5 | 20.9 | 21.7 | ◎ |
| EXAMPLE 6 | 1152 | 1 | 6 | 8.5 | 18.0 | 83.5 | 20.9 | 20.9 | ◎ |
| EXAMPLE 7 | 1152 | 1 | 7 | 8.6 | 0.5 | 80.4 | 20.6 | 25.8 | △ |
| EXAMPLE 8 | 1152 | 1 | 8 | 6.3 | 40.0 | 82.4 | 20.8 | 16.1 | ○ |
| EXAMPLE 9 | 1152 | 1 | 9 | 6.0 | 6.8 | 72.0 | 20.6 | 21.5 | ◎ |
| EXAMPLE 10 | 1152 | 1 | 10 | 9.5 | 6.5 | 94.5 | 20.0 | 22.0 | ◎ |
| EXAMPLE 11 | 1152 | 1 | 11 | 12.9 | 5.8 | 53.0 | 20.3 | 25.0 | ○ |
| EXAMPLE 12 | 1152 | 1 | 12 | 8.5 | 6.9 | 99.0 | 19.9 | 21.5 | ◎ |
| EXAMPLE 13 | 1152 | 1 | 13 | 13.0 | 35.6 | 46.7 | 20.6 | 24.5 | ○ |
| EXAMPLE 14 | 1152 | 1 | 14 | 12.4 | 0.9 | 49.8 | 20.5 | 29.8 | △ |
| COMPARATIVE EXAMPLE 1 | 1152 | 1 | 15 | 0.7 | 0.2 | 32.1 | 21.1 | 45.1 | × |
| COMPARATIVE EXAMPLE 2 | 1152 | 1 | 16 | 30.8 | 42.5 | 25.8 | 19.2 | 42.8 | × |

FIG.2B

| | CHANGE IN ELECTRIC RESISTANCE | | | PRINTING DENSITY | | | FOGGING | COMPREHENSIVE JUDGEMENT |
|---|---|---|---|---|---|---|---|---|
| | ELECTRIC RESISTANCE(Ωcm) | | JUDGEMENT | OD | | JUDGEMENT | | |
| | INITIAL | AFTER 1,000,000 PRINTS | | INITIAL | AFTER 1,000,000 PRINTS | | | |
| EXAMPLE 1 | $10^5 \sim 10^6$ | $10^5 \sim 10^6$ | ◎ | 1.35 | 1.33 | ◎ | ○ | ◎ |
| EXAMPLE 2 | $10^5 \sim 10^6$ | $10^5 \sim 10^6$ | ◎ | 1.36 | 1.25 | ○ | ○ | ○ |
| EXAMPLE 3 | $10^5 \sim 10^6$ | $10^6 \sim 10^7$ | ○ | 1.35 | 1.28 | ○ | ○ | ○ |
| EXAMPLE 4 | $10^5 \sim 10^6$ | $10^5 \sim 10^6$ | ◎ | 1.36 | 1.28 | ○ | ○ | ○ |
| EXAMPLE 5 | $10^5 \sim 10^6$ | $10^6 \sim 10^7$ | ○ | 1.35 | 1.30 | ○ | ○ | ○ |
| EXAMPLE 6 | $10^5 \sim 10^6$ | $10^6 \sim 10^7$ | ○ | 1.36 | 1.28 | ○ | ○ | ○ |
| EXAMPLE 7 | $10^5 \sim 10^6$ | $10^5 \sim 10^6$ | ◎ | 1.34 | 1.28 | ○ | ○ | ○△ |
| EXAMPLE 8 | $10^5 \sim 10^6$ | $10^7 \sim 10^8$ | △ | 1.34 | 1.31 | ◎ | × | ○△ |
| EXAMPLE 9 | $10^5 \sim 10^6$ | $10^6 \sim 10^7$ | ○ | 1.35 | 1.26 | ○ | ○ | ○ |
| EXAMPLE 10 | $10^5 \sim 10^6$ | $10^5 \sim 10^6$ | ◎ | 1.35 | 1.35 | ◎ | ○ | ◎ |
| EXAMPLE 11 | $10^5 \sim 10^6$ | $10^7 \sim 10^8$ | △ | 1.37 | 1.21 | ○ | ○ | ○△ |
| EXAMPLE 12 | $10^5 \sim 10^6$ | $10^6 \sim 10^6$ | ◎ | 1.35 | 1.32 | ◎ | ○ | ◎ (MUCH TIME TO MANUFACTURE) |
| EXAMPLE 13 | $10^5 \sim 10^6$ | $10^6 \sim 10^8$ | × | 1.36 | 0.92 | × | ○ | △ |
| EXAMPLE 14 | $10^5 \sim 10^6$ | $10^7 \sim 10^8$ | △ | 1.36 | 0.86 | × | ○ | △ |
| COMPARATIVE EXAMPLE 1 | $10^5 \sim 10^7$ | $10^8 \sim 10^{10}$ | × | 1.26 | 0.41 | × | ○ | × |
| COMPARATIVE EXAMPLE 2 | $10^5 \sim 10^6$ | $10^9 \sim 10^{10}$ | × | 1.34 | 0.32 | × | ○ | × |

FIG.2C

| | PRINTING RATE | DEVELOPING AGENT | | AGGREGATION DEGREE | SOLUBLE AMOUNT IN CHLOROFORM | COVERAGE | EXCESSIVE CHARGING OF TONER CHARGE | | |
|---|---|---|---|---|---|---|---|---|---|
| | | | | | | | CHARGING AMOUNT (μC/g) | | |
| | (mm/s) | TONER No. | CARRIER No. | (%) | (%) | (%) | INITIAL | AFTER 1,000,000 PRINTS | JUDGEMENT |
| EXAMPLE 15 | 1152 | 1 | 17 | 10.8 | 0.9 | 84.1 | 19.5 | 27.3 | △ |
| EXAMPLE 16 | 1152 | 1 | 18 | 12.1 | 0.7 | 85.1 | 20.3 | 31.2 | × |
| EXAMPLE 17 | 1152 | 1 | 19 | 7.1 | 6.5 | 88.1 | 20.2 | 20.3 | ◎ |
| EXAMPLE 18 | 1152 | 1 | 20 | 7.1 | 1.2 | 88.1 | 20.2 | 23.0 | ○ |
| EXAMPLE 19 | 1152 | 1 | 21 | 11.3 | 0.4 | 89.1 | 20.6 | 32.1 | × |
| EXAMPLE 20 | 1152 | 1 | 22 | 9.3 | 6.8 | 67.9 | 19.9 | 22.1 | ○ |
| EXAMPLE 21 | 1152 | 1 | 23 | 8.3 | 6.6 | 66.8 | 20.1 | 20.9 | ◎ |
| EXAMPLE 22 | 1152 | 1 | 24 | 8.3 | 6.5 | 65.9 | 20.8 | 21.2 | ◎ |
| EXAMPLE 23 | 1152 | 1 | 25 | 7.8 | 6.3 | 62.3 | 20.9 | 20.5 | ◎ |
| EXAMPLE 24 | 1152 | 1 | 26 | 7.1 | 5.9 | 59.2 | 21.5 | 17.5 | ○ |
| EXAMPLE 25 | 1152 | 1 | 27 | 8.5 | 6.8 | 65.8 | 19.3 | 22.5 | ○ |
| EXAMPLE 26 | 1152 | 1 | 28 | 14.8 | 12.6 | 55.2 | 18.2 | 31.5 | × |
| EXAMPLE 27 | 1152 | 1 | 29 | 8.4 | 7.0 | 54.8 | 20.3 | 15.8 | ○ |
| EXAMPLE 28 | 1152 | 2 | 2 | 14.4 | 6.8 | 91.3 | 20.6 | 25.1 | ○ |
| EXAMPLE 29 | 1152 | 3 | 2 | 14.4 | 6.8 | 91.3 | 20.6 | 10.2 | × |
| EXAMPLE 30 | 1152 | 4 | 2 | 14.4 | 6.8 | 91.3 | 20.8 | 16.9 | ○ |
| EXAMPLE 31 | 800 | 1 | 11 | 12.9 | 5.8 | 53.0 | 20.3 | 20.9 | ◎ |
| EXAMPLE 32 | 500 | 1 | 11 | 12.9 | 5.8 | 53.0 | 20.3 | 17.8 | ○ |
| COMPARATIVE EXAMPLE 3 | 1152 | DEVELOPING AGENT AVAILABLE COMMERCIALLY FROM A COMPANY | | 19.7 | 32.5 | 99 | 19.6 | 48.9 | × |
| COMPARATIVE EXAMPLE 4 | 1152 | DEVELOPING AGENT AVAILABLE COMMERCIALLY FROM B COMPANY | | 0.5 | 33.8 | 12.5 | 20.6 | 45.9 | × |

FIG.2D

| | CHANGE IN ELECTRIC RESISTANCE | | | PRINTING DENSITY | | | FOGGING | COMPREHENSIVE JUDGEMENT |
|---|---|---|---|---|---|---|---|---|
| | ELECTRIC RESISTANCE(Ω cm) | | | OD | | | | |
| | INITIAL | AFTER 1,000,000 PRINTS | JUDGMENT | INITIAL | AFTER 1,000,000 PRINTS | JUDGEMENT | | |
| EXAMPLE 15 | $10^5 \sim 10^6$ | $10^6 \sim 10^7$ | ○ | 1.35 | 1.24 | ○ | ○ | ○△ |
| EXAMPLE 16 | $10^6 \sim 10^7$ | $10^7 \sim 10^8$ | ○ | 1.30 | 0.99 | × | ○ | △ |
| EXAMPLE 17 | $10^5 \sim 10^6$ | $10^5 \sim 10^6$ | ◎ | 1.35 | 1.35 | ◎ | ○ | ◎ |
| EXAMPLE 18 | $10^5 \sim 10^6$ | $10^5 \sim 10^6$ | ◎ | 1.35 | 1.35 | ◎ | ○ | ○ |
| EXAMPLE 19 | $10^5 \sim 10^7$ | $10^8 \sim 10^9$ | △ | 1.31 | 0.77 | × | ○ | △ |
| EXAMPLE 20 | $10^5 \sim 10^6$ | $10^8 \sim 10^9$ | × | 1.35 | 1.02 | × | ○ | △ |
| EXAMPLE 21 | $10^5 \sim 10^6$ | $10^7 \sim 10^8$ | △ | 1.30 | 1.25 | ○ | ○ | ○△ |
| EXAMPLE 22 | $10^5 \sim 10^6$ | $10^7 \sim 10^8$ | △ | 1.33 | 1.27 | ○ | ○ | ○△ |
| EXAMPLE 23 | $10^5 \sim 10^6$ | $10^7 \sim 10^8$ | △ | 1.35 | 1.26 | ○ | ○ | ○△ |
| EXAMPLE 24 | $10^5 \sim 10^6$ | $10^8 \sim 10^9$ | × | 1.35 | 1.19 | △ | △ | △ |
| EXAMPLE 25 | $10^5 \sim 10^6$ | $10^7 \sim 10^8$ | △ | 1.34 | 1.22 | ○ | ○ | ○△ |
| EXAMPLE 26 | $10^5 \sim 10^6$ | $10^7 \sim 10^8$ | △ | 1.32 | 1.07 | × | ○ | △ |
| EXAMPLE 27 | $10^4 \sim 10^5$ | $10^7 \sim 10^8$ | × | 1.41 | 1.27 | ○ | × | △ |
| EXAMPLE 28 | $10^5 \sim 10^6$ | $10^6 \sim 10^7$ | ○ | 1.35 | 1.19 | △ | ○ | ○△ |
| EXAMPLE 29 | $10^5 \sim 10^6$ | $10^8 \sim 10^{10}$ | × | 1.35 | 1.39 | ◎ | × | △ |
| EXAMPLE 30 | $10^5 \sim 10^6$ | $10^7 \sim 10^8$ | △ | 1.35 | 1.27 | ○ | △ | ○△ |
| EXAMPLE 31 | $10^5 \sim 10^6$ | $10^6 \sim 10^7$ | ○ | 1.37 | 1.28 | ○ | ○ | ○ |
| EXAMPLE 32 | $10^5 \sim 10^6$ | $10^8 \sim 10^8$ | ◎ | 1.37 | 1.36 | ◎ | △ | ○ |
| COMPARATIVE EXAMPLE 3 | $10^6 \sim 10^7$ | $10^9 \sim 10^{10}$ | × | 0.87 | 0.21 | × | ○ | × |
| COMPARATIVE EXAMPLE 4 | $10^6 \sim 10^7$ | $10^9 \sim 10^{10}$ | × | 0.55 | 0.32 | × | ○ | × |

TWO COMPONENT DEVELOPING AGENT AND AN IMAGE FORMING APPARATUS BY USE OF THE SAME

BACKGROUND OF THE INVENTION

1. Field of the Invention

The present invention relates to a two-component developing agent for use in a development of an electrostatic latent image formed on a photoconductor based on an electrophotography. In addition, the present invention is to provide an image forming apparatus in which the above two-component developing agent is used such that an image formation can be achieved at a high speed and good printing characteristics can be kept for a long time.

2. Description of the Related Art

Electrophotography known in the art includes a system described in U.S. Pat. No. 2,297,691 and the like. In this system, a photoconductor (such as photoconductive drum or the like) is generally used, an even electrostatic charge is provided on a surface of the photoconductor by means of corona discharge or the like. An optical image is applied onto the photoconductor by various means to form an electrostatic latent image thereon that is then developed with a fine powder called a toner.

If necessary, the toner image is transferred onto a recording medium, such as a paper. The toner image is then melted by means of pressing, heating, solvent vaporizing, light irradiating or the like so as to fix the toner image onto the recording medium, thereby providing a printing product. For example, an image forming apparatus for use in the above process includes a printer, a copying machine, a facsimile or the like.

As the developing agent for use in the image forming apparatus, there is known one-component developing agent comprising only a toner particle and a two-component developing agent comprising the toner particle and a carrier. In more recent years, a need exists for the image forming apparatus in which the image formation can be achieved at a higher speed. To this end, it is more suitable to use the two-component developing agent.

The above two-component developing agent comprises a carrier particle having a general magnetic character and an insulating toner particle. In a case where the development of electrostatic latent image is carried out on the photoconductor, only the toner is consumed while stirring the carrier and the toner in a developing container, so that the carrier can be reused. Since a predetermined voltage from the carrier is provided onto the toner with stirring, the toner is transferred to the photoconductor so as to form a toner image thereon. However, a balance between the charging and the discharging of both the toner and the carrier may be broken due to a stirring stress, thereby giving rise to the excessive charging, the stripping of a coating resin from a surface of the carrier and a change in an electric resistance due to filming of the toner onto the surface of the carrier.

Since the developability of the toner is dependent on a charge amount of the toner and a strength of an electric field at a developing region, an excessive increasing of a charging amount of the toner results in a decrease in the number of the toner attractive to the electrostatic latent image, thereby leading to a decrease in a printing density. In addition, with the stripping of the coating resin from the carrier surface and the filming with the toner, the electric resistance of the carrier may be increased. In such a case, the electric field for the development is weakened to deteriorate developability, thereby providing a lower printing density of a print. It is necessary to replace the two-component developing agent with a new one when a state of the toner and carrier becomes worse and the printing density is below an acceptable value.

On the other hand, in a high speed printer where the recording medium is transported at a speed more than 1 m/s and the printing is carried out more than 150 sheets per one minute, there exists a long-felt need for a long-range term of a replacement cycle of the two-component developing agent from the view points of maintenance and the low running cost.

To this end, Japanese Laid-Open Patent Application No. 7-72668 describes a two-component developing agent having a long lifetime by modification of a silicone resin with a fluorine atom. However, the technology disclosed in the above application results in a charge-up due to the excessive charging when printing at the high speed more than 1 m/s, thereby providing the inability of extending the lifetime of the carrier.

Additionally, an extensive study of a coverage of the carrier with the coating resin showed that good printing performance can be obtained with the relative low coverage. For example, Japanese Laid-Open Patent Application No. 4-188162 teaches an approach in which the coverage of the carrier with the coating resin is less than 12%. However, when printing at the higher speed with the developing agent disclosed in the Japanese Laid-Open Patent Application No. 4-188162, an increase in the electric resistance of the carrier can not be inhibited.

Japanese Laid-Open Patent Application Nos. 57-96355 and 1-29856 describe a more than 2 layers coating method by use of the silicone resin and a coating method by mixing different resins, respectively. However, when the image formation is carried out at the high speed by use of the above technologies, the stripping may occur at a boundary face between the resins on each surface of the carriers so that the above technologies can not be applied to the high speed printing based on the electrophotography.

Further, Japanese Laid-Open Patent Application No. 10-20562 teaches the use of the silicone resin having a uncured component of less than 4.3%. In addition, Japanese Patent No. 62-61948 describes the use of silicone resin having the uncured component of less than 30%. Under these conditions, the toner filming and the charge-up problems can not be inhibited sufficiently.

Therefore, the present invention has been made in view of the above-described problems of the prior art.

SUMMARY OF THE INVENTION

Accordingly, it is a general object of the present invention is to provide a two-component developing agent for use in an electrophotographic method and an image forming apparatus by use of the same wherein the foregoing problems are eliminated.

A more specific object of the present invention is to provide the two-component developing agent with which a high developability can be obtained when printing at a high speed and deterioration of developability can be prevented for even a long-term image formation period, and the image forming apparatus utilizing the above two-component developing agent.

The above objects of the present invention are achieved by a two-component developing agent for use in electrophotography, comprising:

a carrier comprising a magnetic particle, a surface of the magnetic particle coated with at least a resin; and an insulating toner, wherein a mean particle size of the magnetic particle is between 30 and 90 μm and an aggregation degree of said carrier is between 2 and 15%.

The above objects of the present invention are also achieved by a two-component developing agent for use in electrophotography, comprising:

a carrier comprising a magnetic particle, a surface of the magnetic particle coated with a resin comprising at least a conductive carbon and a cure-type (i.e., curable) silicone resin, preferably a modified silicone resin, more preferably a cure-type fluorine-modified silicone resin; and an insulating toner, wherein 70 to 95% of the surface of the magnetic particle is covered with a coating layer having a thickness of from 0.3 to 5 μm and a soluble ratio in chloroform of the coating layer is between 5 and 20%, and further wherein a mean particle size of the magnetic particle is between 30 and 90 μm and an aggregation degree of said carrier is between 2 to 15%.

According to one aspect of the present invention, there is provided an image forming apparatus in which an image formation is carried out with a two-component developing agent comprising: a carrier comprising a magnetic particle, a surface of said magnetic particle coated with a resin comprising at least a conductive carbon and a cure-type (i.e., curable) silicone resin, preferably a modified silicone resin, more preferably a cure-type fluorine-modified silicone resin; and an insulating toner, wherein 70 to 95% of the surface of the magnetic particle is covered with a coating layer having a thickness of from 0.3 to 5 μm and a soluble ratio in chloroform of the coating layer is between 5 and 20%, and further wherein a mean particle size of the magnetic particle is between 30 and 90 μm and an aggregation degree of said carrier is between 2 and 15%.

An advantage of the present invention is that it provides a two-component developing agent with which the charge-up due to an excessive charging can be prevented so as to give a stable toner charging during a long period of time.

The two-component developing agent in accordance with the present invention provides another advantage in that a long lifetime of a two-component developing agent can be obtained and the charge-up can be inhibited during a continuous printing.

Yet another advantage of the present invention is that a suitable charging of a two-component developing agent can be attained and abrasion resistance thereof can be improved.

A feature of the present invention is the provision of an image forming apparatus in which a good image formation can be obtained for a long-term.

BRIEF DESCRIPTION OF THE DRAWINGS

Other objects, features and advantages of the present invention will become more apparent from the following detailed description when read in conjunction with the accompanying drawings, in which:

FIGS. 1A through 1D is views showing a part of assessment results of the two-component developing agent according to the present invention;

FIGS. 2A through 2D is views showing a part of assessment results of the two-component developing agent according to the present invention.

DESCRIPTION OF THE PREFERRED EMBODIMENTS

Figure 3:
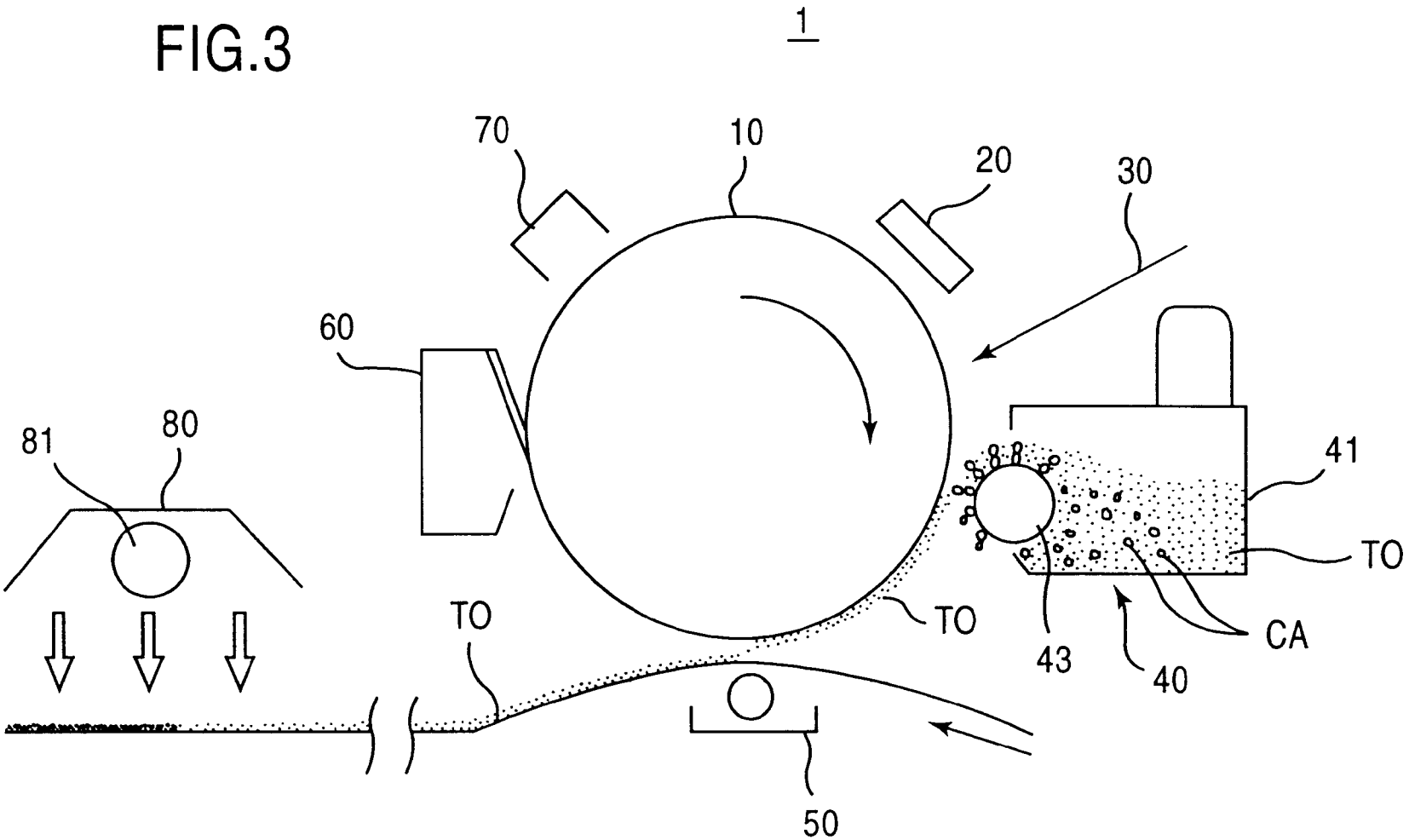
FIG. 3 is a schematic view of a part of an image forming apparatus according to the present invention, which utilizes a two-component developing agent.

A detailed explanation will be given of a two-component developing agent according to the present invention.

It should be noted throughout this specification that the expressions such as "soluble ratios of cure-type (or interchangeably, curable) silicone resin" refer to the soluble ratio of the resin when cured.

According to one aspect of the present invention, it relates to the two-component developing agent for use in electrophotography. The two-component developing agent comprises a carrier comprising a magnetic particle having a particle size of from 30 to 90 μm, a surface of which being coated with at least a resin and an insulating toner. It is possible to have a stable toner charging for a long time without a charge-up due to an excessive charging, by establishing an aggregation degree of the carrier into a predetermined range.

The aggregation degree of the carrier is defined by the following formula (1). When the aggregation degree is above 15%, there is a strong tendency that an aggregation state is dissociated to form an excessive charging when a continuous stirring is carried out in a developing container during a continuous printing. When the aggregation degree is below 2%, on the other hand, there is no occurrence to generate the excessive charging because of a lower aggregation degree, but the prevent inventors have confirmed that developability is likely to be lowered so as to arrive the present invention. Thus, the aggregation degree of the carrier is preferably between 2% and 15%, more preferably between 4% and 10%.

$$\text{Aggregation degree } (\%) = (X/Y) \times 100 - 100 \quad (1)$$

wherein X represents a geometric mean particle size (μm) calculated from a particle size distribution of the carrier coated already; and Y represents a geometric means particle size (μm) calculated from a particle size distribution of a core material in which a coating is removed from the carrier.

A carrier particle is formed by coating resin material on a surface of a particle-like core material having a magnetic character. The aggregation degree according to the present invention is defined by a ratio of the mean particle size of the carrier which is formed by applied the coating onto the surface of the core material to the mean particle size of the core material before coating. The carrier is formed by coating a thin layer on the surface of the core material which is a fine particle. If one particle of the core material must be coated with the coating layer to form one particle of the carrier because the coating layer is a very thin film, the aggregation degree becomes approximately 0%. However, in fact, there are a number of carrier particles which include a plurality of the core materials and are attached each other with the resin materials in an aggregated state. The aggregation degree (%) according to the present invention is defined on a basis of this fact.

A Method of Calculating a Geometric Mean Particle Size for Determination of X and Y Values The following method is used for determination of the mean particle sizes of the carrier and the core.

1) Particles of the carrier and the core are separated according to the particle size, by using a screen having, for example, 177, 149, 105, 74, 63, 44, 37 and 25 μm mesh. A weight of the separated particles is then examined to measure the particle size distribution.

2) Then, the geometric mean particle size X and Y values are determined by the following formula in a combination of the values obtained in the above item 1).

The geometric means particle size ($\mu$m) =

$$(1/100)\times[\{(250+177)/2\}\times\text{sample weight remained on the screen having the 177 }\mu\text{m mesh}+\{(177+149)/2\}\times\text{sample weight remained on the screen having the 149 }\mu\text{m mesh}+\{(149+105)/2\}\times\text{sample weight remained on the screen having the 105 }\mu\text{m mesh}+\{(105+74)/2\}\times\text{sample weight remained on the screen having the 74 }\mu\text{m mesh}+\{(74+63)/2\}\times\text{sample weight remained on the screen having the 63 }\mu\text{m mesh}+\{(63+44)/2\}\times\text{sample weight remained on the screen having the 44 }\mu\text{m mesh}+\{(44+37)/2\}\times\text{sample weight remained on the screen having the 37 }\mu\text{m mesh}+\{(37+25)/2\}\times\text{sample weight remained on the screen having the 25 }\mu\text{m mesh}+\{(25)/2\}\times\text{sample weight remained on the screen having the 25 }\mu\text{m mesh}]$$

The following will be a description of the specific procedure in order to determine the aggregation degree (%).

1) The carrier particle is only obtained by completely removing the toner from the two-component developing agent prior to use, by cleaning with a surfactant, or by means of an airflow size classification apparatus or the screen having the 25 $\mu$m mesh.

2) The particle size distribution of the carrier thus obtained in 1) is measured to gain the particle size distribution of the carrier. Herein the above X value can be obtained.

3) Next, preparation is carried out for determination of the particle size distribution of the core material. In a case where the coating layer for the carrier surface is an acrylic resin or the like and the resin can be decomposed by an action of heat, the coating layer is removed by subjecting it to heating treatment. However, a temperature of the heating treatment is up to a temperature where the core material is not melted. For example, the heating treatment is preferably carried out under the condition of 200° C. to 700° C. for 15 minutes.

4) Since the coating layer can not be removed completely in a case where the coating layer is a cured-type straight silicone resin, a modified silicone resin with an acrylic resin, a polyester resin, an epoxy resin, an alkyd resin, an urethane resin or the like, a cured-type fluorine-modified silicone resin and the like, the carrier thus obtained in 2) is added to an alkaline solution having a concentration of from 5 to 20% at a temperature of from 50 to 100° C., followed by stirring more than one hour to yield a core material.

5) Then, washing is sufficiently performed with water to transfer the core material to a drying apparatus. A water content is removed completely in the apparatus.

6) A core material particle is obtained by dissociation of an aggregation due to the coating resin by means of the treatment described in 3) or 5). Thus, the particle size distribution of the core material is obtained so as to determine the Y value by use of the above formula.

Calculation of the Aggregation Degree

The aggregation degree (%) is calculated by the formula (1) with the X value obtained from the particle size distribution of the carrier and the Y value obtained from the particle size distribution of the core material.

$$\text{Aggregation degree (\%)}=(X/Y)\times 100-100 \quad (1)$$

When the above aggregation degree (%) is between 2 and 15% in a case where the mean particle size of the magnetic particle (core material) is in a range of from 30 to 90 $\mu$m, a good two-component developing agent is made with the stable toner charging for the long time without the charge-up due to the excessive charging. As will be clear from the following examples, effect of such a range of the aggregation degree will be elucidated in detailed give below.

With respect to the two-component developing agent for use in electrophotography, which comprises a carrier formed by coating the surface of the magnetic particle with at least the cure-type silicone resin and the insulating toner, the long lifetime of the agent can be achieved by establishing a soluble ratio in chloroform of a coating layer comprising the silicone resin into a predetermined range, so that the excessive charge-up due to the continuous printing can be inhibited and the stable toner charging can be realized for the long time.

The present inventors have turned their attentions to the cure-type silicone resin used for coating the surface of the carrier. On a basis of recognition that it is not preferred that this resin layer is too rigid or too flexible, the present inventor have confirmed that a preferred two-component developing agent can be obtained by establishing the soluble ratio in chloroform of the coating layer into the predetermined range. When the soluble ratio in chloroform of the silicone resin is below a lower limit, coating layer for the carrier is likely to be hard. In this case, this coating layer exhibits good abrasion resistance, but a balance between the charging and discharging of the carrier is broken to be likely to generate the excessive charge-up due to the continuous printing. When the above soluble ratio is more than an upper limit, on the other hand, the coating layer for the carrier becomes flexible to be worn easily.

The following is a detailed description of a method for measuring a soluble amount in chloroform of the coating layer for the carrier.

Measurement of the Soluble Amount in Chloroform of the Coating Layer for the Carrier 1) The carrier particle is only obtained by completely removing the toner from the two-component developing agent prior to use, by cleaning with a surfactant, or by means of an airflow size classification apparatus or the screen having the 25 $\mu$m mesh.

2) 5 g of the carrier thus obtained in 1) is added into two beakers, respectively. An ion-exchanged water is added into one of the beakers, and chloroform is added into the other, so that the carrier in each beaker can be immersed separately.

3) After each beaker is washed supersonically for 10 minutes, twice rinses with the same solution is carried out.

4) Drying is performed more than 3 hours at a temperature of 50° C.

5) An analysis for a carbon amount of the carrier is carried out for each beaker. Five-time runs of the analysis are performed so as to discard a maximum and a minimum data. Three remaining data is averaged to yield a means value for each beaker. It should be noted that the analysis of the carbon amount is implemented by means of a carbon analyzing device EMIA-110 manufactured by HORIBA SEISAKUSYO Co. Ltd.

6) A coating resin for the coating layer, which is cured therein to form a polymer, is insoluble in chloroform, while an uncured resin is soluble in chloroform. It is presumed that a hardness of the carrier surface is dependent on such an uncured resin in the coating layer for the carrier. This uncured resin is not almost soluble in water. Thus, the soluble ratio in chloroform is defined as the following formula (2):

$$\text{Soluble ratio in chloroform } (\%)=(A-B)/A\times 100 \quad (2)$$

wherein A (g) represents the carbon amount in 100 g of the carrier washed with water, and B (g) represents the carbon amount in 100 g of the carrier washed with chloroform.

When the soluble ratio in chloroform (%) is between 5% and 20%, good charging property for the toner and the carrier can be realized and the two-component developing agent having the above soluble ratio meets the requirement relating to abrasion resistance. A value of the soluble ratio in chloroform is preferably between 5 and 10%, more preferably between 5 and 7%. An advantage of such a range is elucidated in detailed given below.

Next, with respect to the two-component developing agent for use in electrophotography, which comprises a carrier formed by coating the surface of the magnetic particle with material comprising a cure-type (i.e., curable) silicone resin, preferably a modified silicone resin, more preferably a cure-type fluorine-modified silicone resin and a conductive carbon, and the insulating toner, loss in the charge-up and abrasion resistance can be ameliorated by establishing a coverage of the carrier surface with a coating layer comprising the above silicone resin having a thickness of from 0.3 to 5 $\mu$m into a predetermined range. Thus, this provides the two-component developing agent having the long lifetime sufficient to ensure a period before affecting printing performance adversely.

The present inventors have turned their attentions to the cure-type silicone resin used for coating the surface of the carrier. It is preferred that this silicone resin is subject to treatment of fluorine modification and the conductive carbon is also contained in the carrier. The present inventors have confirmed that the surface of the magnetic particle (namely, core material) is covered with the resin comprising the above silicone resin and the conductive carbon and having the thickness of from 0.3 to 5 $\mu$m at coverage from 70 to 95% so as to provide a desirable two-component developing agent.

Such a two-component developing agent provides an improvement of an appropriate charging and abrasion resistance. Since a coating state becomes unstable when the coverage of the coating layer having the thickness of from 0.3 to 5 $\mu$m is below 70%, the coating layer tends to strip and the lifetime of the carrier is likely to shorten because of the continuous printing at the high speed. On the other hand, it is impractical to produce the two-component developing agent having the coverage of more than 95% the coating layer, because of a long time required to produce and an increase in costs. Therefore, it is preferred that the coverage is between 70 and 95%, more preferably between 80 and 95%. It should be noted that it is preferable for the coating layer to have the thickness of from 0.3 to 5 $\mu$m in terms of abrasion resistance and charging control.

Now, the coverage of the surface of the carrier with the coating layer is measured as follows:

1) The surface is subjected to deposition treatment with platinum (Pt). An aim to cover the carrier surface with Pt is that it is necessary to embed a carrier particle with a resin material for fixation in order to measure the coverage of the carrier particle. A cross-section of the carrier particle is exposed by cutting the resin material for fixation to observe a state of the coating layer of the carrier. In order to make a clear distinction of a boundary line between a resin layer of the carrier surface and the resin material for fixation for use in embedment, and prevent a swell of the resin layer in embedding, a deposition layer comprising Pt is formed on the carrier surface.

2) For example, after embedding the carrier with a epoxy resin for fixation, drying is carried out sufficiently to cut the carrier, so that a shape of the cross-section of the carrier can be observed.

3) For example, with respect to 50 carriers having the cross-section formed by cutting to expose, the cross-section is observed by means of a scanning electron microscope (SEM) along an outer periphery of the carrier. The coverage is determined by a ratio of a region having the thickness ranging from 0.3 to 5 $\mu$m to a region having the thickness outside the range from 0.3 to 5 $\mu$m.

It should be noted that it is recommended that a conductive carbon contained in the coating layer has a specific surface area of from 700 to 1500 $m^2/g$, which is estimated by a BET method. When the specific surface area is less than 700 $m^2/g$, it is difficult to reduce an electric resistance of the carrier inadequately, thus providing inability to eliminate the charge-up problem. When the specific surface are is also more than 1500 $m^2/g$, it is difficult to disperse the conductive carbon in the coating layer successfully, thereby leading to difficulty in ensuring the long lifetime of the coating layer because of easy abrasion thereof.

Additionally, in a case of development with the two-component developing agent, in particular, a charge-up phenomenon is likely to occur at an initial stage of printing (developing). To avoid this, the charge-up problem can be ameliorated by setting a content of the conductive carbon in a surface side of the coating layer above that in an inner side thereof. On the contrary, when the content of the carbon in the surface side is less than that in the inner side, much charge-up occurs to deteriorate initial developability.

From the foregoing, it is apparent that the two-component agent according to the present invention provides sufficient abrasion resistance even at the high speed printing, and an appropriate charging can be ensured for the long period of time.

The following will be a description of materials used for the two-component developing agent according to the present invention.

First of all, a core material is described as the magnetic particle which is a main element of the carrier.

Examples of such magnetic particles used in the present invention include ferrite, magnetite, iron powder or the like. In particular, it is preferred that manganese ferrite has a strong magnetic force and is approximately spherical shape from a viewpoint of the long lifetime. More preference is given to manganese ferrite expressed in the following formula (I):

$$(MnO)_x(Fe_2O_3)_y \quad (I)$$

wherein x and y are mole percents such that x+y=100 and x is in a range of from 10 to 45.

When x, namely mole ratio of MnO, is less than 10 mol %, stability of a ferrite compound after formation reaction of ferrite tends to become worse. This results in poor developability because of a change in resistance due to stress or the like. On the other hand, when x mole % of MnO is more than 45 mol %, the shape of the ferrite is deformed and the carrier surface adheres to the toner by an action of the stress or the like in a developing container. This results in an easy change in resistance due to a filming phenomenon.

As a method for producing manganese ferrite mentioned above, each raw material of metal oxide, metal carbonate salt metal hydroxide are formulated in an appropriate amount such that for example, manganese ferrite comprises 20 mol % of MnO and 80 mol % of $Fe_2O_3$. Water is then added and pulverization and mixing are performed for 10 hours by means of a dry-type ball mill. After drying, a temperature of 950° C. is kept for 4 hours. The pulverization is also carried out for 24 hours by means of the dry-type ball mill to form a particle size having less than 5 μm. This slurry is dried granularly to be allowed to a temperature of 1300 C for 6 hours at an atmosphere of nitrogen to form a particle. Afterwards, the particle thus obtained is also ground to form a desired particle size distribution through classification.

A preferred carrier used in the present invention preferably comprises a core material based on ferrite having the mean particle size of from 30 to 90 μm, more preferably 50 to 80 μm. When the particle size is less than 30 μm, carrier adhesion is likely to occur. On the other hand, when the particle size is more than 90 μm, there is a tendency that an image quality is degraded. The carrier can be formed by coating the resin on the surface of the carrier by means of a conventional method, for example, a spray-drying method with a fluid bed, a rotary drying method, a liquid immersion drying method with a multi-purpose stirrer. In order to increase the coverage of the surface of the carrier, it is preferable to utilize a method with the fluid bed.

As the resin to cover the surface of the carrier used in the present invention, use is made of various types of the resins. Examples of such resins include a resin containing a fluorine atom, a acrylic resin, an epoxy resin, a polyester resin, a acrylic resin containing the fluorine atom, a acrylate-styrene resin, a silicone resin, a modified silicone resin modified by the acrylic resin, the polyester resin, the epoxy resin, an alkyd resin, a polyurethane resin or the like, a cure-type fluorine-modified silicone resin and the like. It is preferable to use the silicone resin, the fluorine-modified silicone resin. More preference is given to the fluorine-modified silicone resin. It is also possible to add a charge controlling agent and resistance controlling agent according to need. Examples of such silicone resins include those having a repeated unit as shown in the following formulae (II) and (III):

(II)

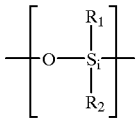

(III)

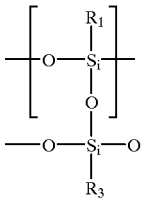

wherein $R_1$, $R_2$ and $R_3$ independently represent hydrogen, halogen, hydroxy, methoxy, $C_1$–$C_4$ alkyl, organic group such as phenyl group or the like.

In addition, examples of such fluorine-modified silicone resins include the cure-type fluorine-modified silicone resin formed by hydrolysis of the above formulae (II) and (III) with an organosilicon compound having a perfluoroalkyl group. Examples of such an organosilicon compound include $CF_3CH_2CH_2Si(OCH_3)_3$, $C_4F_9CH_2CH_2Si(CH_3)(OCH_3)_2$, $C_8F_{17}CH_2CH_2Si(OCH_3)_3$, $C_8F_{17}CH_2CH_2Si(OC_2H_5)_3$, $(CF_3)_2CF(CF_2)_8CH_2CH_2Si(OCH_3)_3$ or the like.

As the coverage with such resins, it is preferable to use 0.05 to 10.0 wt % of the resins against the core material of the carrier, more preferably 0.5 to 7 wt %. When being less than 0.05 wt %, it is difficult to cover the carrier surface uniformly. On the other hand, when being more than 10.0 wt %, there is generated an excessive aggregation of the carriers.

After covering the core material with the resin, it is possible to utilize an external heating method or an internal heating method in the case of baking. For example, it is possible to bake by a fix-type or a flow-type electric furnace, a rotary-type furnace, a burner furnace, or microwave. A baking temperature is dependent on the kind of the resin used therefor. It is necessary to carry out at the temperature more than a melting point or a glass transition temperature of the used resin. For a thermosetting resin or a condensation-cure resin, it is necessary to raise the temperature sufficient to cure the above resin. For example, in a case of curing the silicone resin, this resin is required to keep at 200 to 300° C. for 30 minutes.

In this way, the surface of the core material is covered with the resin. After baking, the core material is allowed to cooling and is then ground to yield the carrier particle which has the desired particle size and which is coated with the coating layer comprising the resin.

Post-treatment is also carried out in order to remove a surface roughness or a burr of the coating layer or to dissociate the aggregation of the carrier particles due to the coating layers. A method for post-treatment may include any methods known in the art, which provide a mechanical stress on the carrier particle. Examples of such methods include, but are not limited to, Nauta mixer, a ball mill, a Vibro mill or the like.

It should be noted that there are many methods for varying the aggregation degree of the carrier described above. For example, after coating and baking, post-treatment is carried out by an action of the mechanical stress so as to dissociate the aggregation of the carrier. The aggregation degree of the carrier can also be changed by varying an amount of a coating agent per unit time, which is spray-coated. A drying rate of the coating agent can also be changed according to the kind of the coating resin and a dilution solvent, so that the aggregation degree can be made changeable.

There are many methods for use in change of the soluble amount in chloroform. For example, it is possible to vary a cure temperature, a cure time and a cure device. The soluble amount in the chloroform can also be changed with the kind of the coating resins, the kind of curing agents or hardening catalysts and amounts thereof.

The coverage can also be changed by shapes of the core material and the surface thereof, amounts of the coating and of the coating agent for use in spraying per unit time, or post-treatment conditions by the action of the mechanical stress.

The following will be a description of the toner particle usable for the present invention. As the toner usable in a combination with the above carrier, it is recommended to use a toner based on a polyester resin which comprises as an alcohol component the following bisphenol A which includes an alkylene oxide adduct. From the viewpoint of filming resistance against the carrier particle, it is preferable to use such a polyester resin.

The polyester preferably comprises the alkylene oxide adduct of bisphenol A having more than 80 mol % of a total alcohol component of the polyester, more preferably more than 90 mol %, most preferably 95 mol %. When an amount of the alkylene oxide adduct of bisphenol A is less than 80 mol %, it is not suitable for the toner, because much use is made of monomers which relatively lead to generation a bad smell.

Examples of such alkylene oxide adducts of bisphenol A include compounds having the following formula (IV):

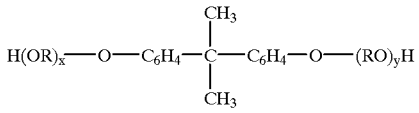

(IV)

wherein R represents ethylene, propylene and x and y are integers equal to or more than 1. More specifically, examples of such compounds include polyoxypropylene(2.2)-2,2-bis(4-hydroxyphenyl)propane, polyoxypropylene(3.3-2,2-bis(4-hydroxyphenyl)propane, polyoxyethylene(2.0)-2,2-bis(4-hydroxyphenyl)propane, polyoxyethylene(2.2)-2,2-(4-hydroxyphenyl)propane, polyoxypropylene(2.0)-polyoxyethylene(2.0)-2,2-bis(4-hydroxyphenyl)propane, polyoxypropylene(6)-2,2-bis(4-hydroxyphenyl)propane or the like.

Among these compounds, preference is given to polyoxypropylene(2.2)-2,2-bis(4-hydroxyphenyl)propane, polyoxyethylene(2.2)-2,2-bis(4-hydroxyphenyl)propane, polyoxyethylene(2.0)-2,2-bis(4-hydroxyphenyl)propane or the like. These compounds may be used alone or in combination.

It should be noted that in a case of flash fixation as a fixation method, it is preferable to use as the alcohol component more than 60 mol % of alkylene oxide adduct of bisphenol A wherein x and y are one and R is ethylene group, more preferable more than 80 mol %. This is because the compound wherein x and y are one and R is ethylene group is most reactive among the compound stated above, and a remaining monomer in the polyester resin can be lowered, for example, dimer, trimer or the like.

According to need, it is also possible to use other alcohol components in combination with the above compounds. Examples of other alcohols include diols, such as ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol or the like, and di-functional alcohols, such as bisphenol A, hydrogenerated bisphenol A or the like.

In addition, as a tri- or more functional alcohol component, examples of such a component include sorbitol, 1,2,3,6-hexanetetol, 1,4-sorbitan, pentaerythritol, dipentaerythritol, tripentaerythritol, 1,2,4-butanetriol, 1,2,5-pentanetriol, gylcerol, 2-methylpropanetriol, 2-methyl-1,2,4-butanetriol, trimethlolethane, trimethylolpropane or the like.

As an acid component for preparation of the polyester resin, it is preferable to use terephthalic acid, isophthalic acid, orthophthlic acid or anhydrides thereof and the like, more preferable terephthalic acid/isophthalic acid. The compounds may be used alone or in combination. It should be noted that other acid components than the above may be used in combination in order to avoid problems relating to a smell in a case of flash fixation. Examples of such acids include maleic acid, fumaric acid, citraconic acid, itaconic acid, glutaconic acid, cyclohexanedicarboxylic acid, succinic acid, adipic acid, sebacic acid, azelaic acid, malonic acid, or alkyl or alkenylsuccinic acids such as n-butylsuccinic acid, n-butenylsuccinic acid, iso-butylsuccinic acid, iso-butenylsuccinic acid, n-octylsuccinic acid, n-octenylsuccinic acid, n-dodecylsuccinic acid, n-dodecenylsuccinic acid, iso-dodecylsuccinic acid, iso-dodecenylsuccinic acid, or anhydrides and lower alkyl esters thereof and the like. In order to create crosslinking into polyester resin, it is also possible to use tri- or more than functional carboxylic acid in combination with other acid components. Examples of such tri- or more than functional carboxylic acids include 1,2,4-benzenetricarboxylicacid, 1,3,5-benzenetricarboxylic acid, or poly-carboxylic acids and anhydrides thereof.

In order to accelerate reaction between the alcohol component and the acid component, it is possible to use usual catalyst for use in esterification, for example, zinc oxide, stannous oxide, dibutyltin oxide, dibutyltin dilaurylate or the like.

The toner can be made in a conventional method, such as a grinding method or the like. For example, a binder resin, a coloring agent and the charge controlling agent are molted and kneaded by means of a pressure kneader, a roll mill, an extruder or the like to form an uniform dispersion. After cooling, the dispersion is then pulverized by means of a jet mill or the like to form a toner having a desired particle size distribution through classification with a classifier, such as a wind power classifier. As constructive components for the toner, the toner comprises a thermoplastic binder resin, carbon black, the charge controlling agent. The toner also comprises a wax, a magnetic powder, a viscosity-adjusting agent, other additives according to need.

In addition to the polyester resin for the binder resin, it is possible to use a styrene-acrylic resins polyetherpolyol, polyurethane, a silicone resin or the like, alone or in combination according to need. It should be noted that the toner preferably comprises the charge controlling agent. It is also possible to use nigrosine, quaternary ammonium salts, organometal complexes, chelate complexes or the like. The particle size of the toner is preferably in a range of from 5 to 13 $\mu$m. It should be noted that as an external additive, it is also possible to use titanium oxide, barium titanate, a fluorine-base fine particle, an acrylate-base fine particle or the like. As a silica fine particle, use is made of TG820 (Cabot Corporation) and K2159 (Clariant Corporation) which are commercially available.

The two-component developing agent according to the present invention can be formed by mixing the carrier particle described above and the toner particle with a concentration of from 1 to 10 wt %, more preferably 2 to 6 wt %, by means of Nauta mixer or the like.

Embodiment

The following will be a detailed description for the two-component developing agent according to the present invention, but the present invention is not limited to the following embodiments. It should be noted that assessment results of the carrier and the toner manufactured by several examples according to the present invention are summarized in FIGS. 1A to 1D and FIGS. 2A to 2D.

Referring to FIGS. 1A through 1D, there are provided data of manufacturing conditions for a plurality of carriers when changing the aggregation degree of the carrier, the soluble amount in chloroform, the coverage or the like. FIGS. 2A through 2D illustrate data for the assessment results of a excessive charging state of the toner charging, an electric resistance change of the carrier, printing density and fogging, together with the results of the aggregation degree of the carrier, the soluble amount in chloroform and the coverage, when using the two-component developing agent according to the present invention. As a comprehensive assessment, there are shown very excellent (◎), excellent (○), good(○Δ), not suitable (Δ) and worse (X). The assessment of the two-component developing agent according to the present invention is carried out for the continuous printing by means of a high speed printer F6760D (manufactured by Fujitsu Limited) at the high speed of 1152 mm/s.

First of all, manufacturing examples are described in the following.

Carrier Manufacturing Example 1

Each raw material was formulated in an appropriate ratio such that manganese ferrite comprises 20 mol % of MnO and 80 mol % of $Fe_2O_3$. Water was then added and pulverization and mixing were performed for 10 hours by means of a dry-type ball mill. After drying, a temperature of 950° C. was kept for 4 hours. The pulverization was also continued for 24 hours by means of the dry-type ball mill and a slurry was dried granularly to be allowed to a temperature of 1300° C. for 6 hours at an atmosphere of nitrogen. Afterwards, the particle thus obtained was also ground to form a manganese ferrite particle (the core material) having a desired particle size distribution. This manganese ferrite exhibited 95 emu/g of magnetization in the application of 3000 Oe of a magnetic field.

Next, 200 g of the cure-type fluorine-modified silicone resin containing 15% of trifluoropropyl group was weighted on a solid base and was then dissolved in 1000 cc of toluene. The conductive carbon (KETJENBLACK manufactured by LION Corp. EC600JD, the specific surface area was estimated to be 1270 $m^2/g$ by a BET method.) was dispersed in the above toluene by means of a Pearlmill to form a coating solution.

The coating solution having the above carbon dispersed therein was coated by adjusting a spray amount per unit time such that it took one hour to coat this solution by means of a fluid bed coating device, relative to 10 kg of the manganese ferrite particle. Baking operation was then carried out at 270° C. for one hour, and followed by grinding treatment. The post-treatment was then performed for 30 minutes by means of a vibration-type mill to form a carrier 1.

The mean particle size, namely X value, of this carrier 1 was measured to be 80.8 μm. The mean particle size, namely Y value, of the magnetic particle (the core particle) was measured to be 75.1 μm. The aggregation degree, the soluble amount in chloroform and the coverage were also measured to be 7.6%, 6.1% and 85.5%, respectively.

Carrier Manufacturing Example 2

The carrier 2 was prepared in a manner similar to carrier manufacturing example 1, with the exception that a time used for the post-treatment with the vibration-type mill was 3 minutes. The aggregation degree, the soluble amount in chloroform and the coverage were also measured to be 14.4%, 6.8% and 91.3%, respectively, as shown in FIG. 2A.

Carrier Manufacturing Example 3

The carrier 3 was prepared in a manner similar to carrier manufacturing example 1, with the exception that a time used for the post-treatment with the vibration-type mill was 120 minutes. The aggregation degree, the soluble amount in chloroform and the coverage were also measured to be 2.2%, 5.7% and 87.2%, respectively, as shown in FIG. 2A.

Carrier Manufacturing Example 4

The carrier 4 was prepared in a manner similar to carrier manufacturing example 1, with the exception that coating time was set to 0.7 hours by changing the spray amount of the coating resin solution per unit time.

In this case, the aggregation degree, the soluble amount in chloroform and the coverage were shown in FIG. 2A.

In the following, results are given in FIGS. 1A through 1D and FIGS. 2A through 2D with the mean particle size of the core material, the mean particle size after coating, the aggregation degree, the soluble amount in chloroform and the coverage.

Carrier Manufacturing Example 5

The carrier 5 was prepared in a manner similar to carrier manufacturing example 1, with the exception that coating time was set to 1.5 hours by changing the spray amount of the coating resin solution per unit time.

Manufacturing Example 6

The carrier 6 was prepared in a manner similar to carrier manufacturing example 1, with the exception that cure time was changed to be 0.5 hours.

Carrier Manufacturing Example 7

The carrier 7 was prepared in a manner similar to carrier manufacturing example 1, with the exception that cure temperature and time were changed to be 300° C. and 5 hours, respectively.

Carrier Manufacturing Example 8

The carrier 8 was prepared in a manner similar to carrier manufacturing example 1, with the exception that cure temperature and time were changed to be 220° C. and 0.1 hours, respectively.

Carrier Manufacturing Example 9

The carrier 9 was prepared in a manner similar to carrier manufacturing example 1, with the exception that the coating amount was changed to be 1.7 wt % relative to the weight of the core material.

Carrier Manufacturing Example 10

The carrier 10 was prepared in a manner similar to carrier manufacturing example 1, with the exception that the coating amount was changed to be 2.3 wt % relative to the weight of the core material.

Carrier Manufacturing Example 11

The carrier 11 was prepared in a manner similar to carrier manufacturing example 1, with the exception that coating time was set to 0.5 hours by changing the spray amount of the coating resin solution per unit time.

Carrier Manufacturing Example 12

The carrier 12 was prepared in a manner similar to carrier manufacturing example 1, with the exception that coating time was set to 10 hours by changing the spray amount of the coating resin solution per unit time.

Carrier Manufacturing Example 13

The carrier 13 was prepared in a manner similar to carrier manufacturing example 1, with the exception that coating time was set to 0.5 hours by changing the spray amount of the coating resin solution per unit time and the cure time was changed to be 0.1 hours.

Carrier Manufacturing Example 14

The carrier 14 was prepared in a manner similar to carrier manufacturing example 1, with the exception that coating time was set to 0.5 hours by changing the spray amount of the coating resin solution per unit time and the cure time was changed to be 5 hours.

Carrier Manufacturing Example 15

The carrier 15 was prepared in a manner similar to carrier manufacturing example 1, with the exception that the coating amount, the coating time, the cure temperature, the cure time and the time for post-treatment were changed to be 1.0 wt %, 0.2 hours, 300° C., 5 hours and 120 minutes, respectively.

Carrier Manufacturing Example 16

The carrier 16 was prepared in a manner similar to carrier manufacturing example 1, with the exception that the coating amount, the coating time, the cure temperature, the cure time and the time for post-treatment were changed to be 1.5 wt %, 0.2 hours, 220° C., 0.05 hours and 0.3 minutes, respectively.

Carrier Manufacturing Example 17

The carrier 17 was prepared in a manner similar to carrier manufacturing example 7, with the exception that the conductive carbon (KETJENBLACK EC(manufactured by LION Corp.)) was used which has the specific surface area of 800 $m^2/g$.

Carrier Manufacturing Example 18

The carrier 18 was prepared in a manner similar to carrier manufacturing example 7, with the exception that the furnace black RAVEN 7000 (manufactured by Columbia Carbon Co. Ltd) was used which has the specific surface area of 639 $m^2/g$.

Carrier Manufacturing Example 19

The carrier 19 was prepared in a manner similar to carrier manufacturing example 1, with the exception that within 2 wt % of the coating amount, 15 wt % of the conductive carbon was contained in 1.9 wt % of the coating amount as an underlayer and 17.5 wt % of the conductive carbon was contained in 0.1 wt % of the coating amount as a surface layer.

Carrier Manufacturing Example 20

The carrier 20 was prepared in a manner similar to carrier manufacturing example 7, with the exception that within 2 wt % of the coating amount, 15 wt % of the conductive carbon was contained in 1.9 wt % of the coating amount as an underlayer and 17.5 wt % of the conductive carbon was contained in 0.1 wt % of the coating amount as a surface layer.

Carrier Manufacturing Example 21

The carrier 21 was prepared in a manner similar to carrier manufacturing example 7, with the exception that within 2 wt % of the coating amount, 15 wt % of the conductive carbon was contained in 1.9 wt % of the coating amount as an underlayer and 2.0 wt % of the conductive carbon was contained in 0.1 wt % of the coating amount as a surface layer.

Carrier Manufacturing Example 22

The carrier 22 was prepared in a manner similar to carrier manufacturing example 1, with the exception that each raw material were formulated in an appropriate amount such that manganese ferrite as the core material comprises 5 mol % of MnO and 95 mol % of $Fe_2O3$, the coating amount was 1.5 wt % and the coating time was 0.5 hours.

Carrier Manufacturing Example 23

The carrier 23 was prepared in a manner similar to carrier manufacturing example 1, with the exception that each raw material were formulated in an appropriate amount such that manganese ferrite as the core material comprises 10 mol % of MnO and 90 mol % of $Fe_2O3$, the coating amount was 1.5 wt % and the coating time was 0.5 hours.

Carrier Manufacturing Example 24

The carrier 24 was prepared in a manner similar to carrier manufacturing example 1, with the exception that each raw material were formulated in an appropriate amount such that manganese ferrite as the core material comprises 20 mol % of MnO and 80 mol % of $Fe_2O_3$, the coating amount was 1.5 wt % and the coating time was 0.5 hours.

Carrier Manufacturing Example 25

The carrier 25 was prepared in a manner similar to carrier manufacturing example 1, with the exception that each raw material were formulated in an appropriate amount such that manganese ferrite as the core material comprises 40 mol % of MnO and 60 mol % of $Fe_2O_3$, the coating amount was 1.5 wt % and the coating time was 0.5 hours.

Carrier Manufacturing Example 26

The carrier 26 was prepared in a manner similar to carrier manufacturing example 1, with the exception that each raw material were formulated in an appropriate amount such that manganese ferrite as the core material comprises 55 mol % of MnO and 45 mol % of $Fe_2O_3$, the coating amount was 1.5 wt % and the coating time was 0.5 hours.

Carrier Manufacturing Example 27

The carrier 27 was prepared in a manner similar to carrier manufacturing example 24, with the exception that a straight silicone resin (Trade name SR-2411, manufactured by Dow Corning Toray Silicone Co., Ltd.) was used as the coating resin.

Carrier Manufacturing Example 28

The carrier 28 was prepared in a manner similar to carrier manufacturing example 24, with the exception that an acrylate-modified silicone resin (Trade name KR-9706, manufactured by Shinetsu Chemical Co. Ltd) was used as the coating resin.

Carrier Manufacturing Example 29

The carrier 29 was prepared in a manner similar to carrier manufacturing example 24, with the exception that the magnetic particle as the core material was changed to be magnetite having the mean particle size of 75.2 $\mu$m The following will be a description of toner manufacturing examples.

Toner Manufacturing Example 1

85 parts by weight of the polyester resin (FN118), manufactured by Kao Co. Ltd.) formed of an propylene oxide adduct of the bisphenol A, 10 parts by weight of carbon black (BLACK PEARLS L, manufactured by Cabot Corporation, the mean particle size 2.4 $\mu$m, the specific surface area:138 $m^2/g$) as a coloring agent, 1 part by weight of nigrosine dye (N-13, manufactured by Orient Chemical Co. Ltd) and 94 parts by weight of propylene wax (BISCOR 550P, manufactured by Sanyo Kasei Co. Ltd) were molted and kneaded at 160° C. for 30 minutes by a kneader under the pressure to yield a toner lump. This toner lump was ground and 0.5 parts by weight of silica (TG820F, manufactured by Cabot Corporation) was then added externally by a high speed stirrer (Henschel mixer) to form a toner 1.

Toner Manufacturing Example 2

A toner 2 was prepared in a manner similar to toner manufacturing example 1, with the exception that the binder resin was replaced with a polyester resin from the propylene oxide adduct of bisphenol A.

Toner Manufacturing Example 3

A toner 3 was prepared in a manner similar to toner manufacturing example 1, with the exception that the binder resin was replaced with a styrene-acrylate resin from the propylene oxide adduct of bisphenol A.

Toner Manufacturing Example 4

A toner 4 was prepared in a manner similar to toner manufacturing example 1, with the exception that the binder resin was replaced with 80% of the polyester resin used for the toner 2 and 20% of the styrene-acrylate resin used for the toner 3.

A description will be given of examples using the carrier and the toner stated above.

EXAMPLE 1

The two-component developing agent was prepared with a concentration of 4.5 wt % from the carrier 1 and the toner 1. An practical printing experiment was conducted by means of the high speed printer F6760D (manufactured by Fujitsu Limited) at a printing speed of 1152 mm/s with this developing agent.

Assessment results are shown in FIGS. 2A and 2B. From the results, an initial charging amount of the toner was 20.1 $\mu$C/g and a charging amount after printing 1,000,000 sheets was 21.6 $\mu$C/g. For the electric resistance, an initial value was $10^5$ to $10^6$ Ωcm and no change was observed for the value after printing 1,000,000 sheets. From the observation of the printing density by means of Konika densitometer (PDA-65), initial value thereof was 1.35 and a value thereof after printing 1,000,000 sheets was 1.33. In addition, the observation of fogging revealed that there was no change in fogging level from the initial printing to 1,000,000 runs.

An judgement standard for the assessment by the practical printing test was as follows:

1) With respect to change in charging amount: Δ (initial charging amount−charging amount after 1,000,000 printing)

less than 2 $\mu$C/g◎

2.1 to 5.0 $\mu$C/g○

5.1 to 10.0 $\mu$C/gΔ more than 10.1 $\mu$C/gX

2) With respect to change in electric resistance: Δ (initial electric resistance−electric resistance after 1,000,000 printing)

almost no change ◎

$10^1$ Ωcm○

$10^2$ ΩcmΔ

$10^3$ ΩcmX

3) With respect to printing density after 1,000,000 printing

The printing density was measured after 1,000, 000 printing by means of Konica densitometer (PDA-65).

more than 1.31◎

1.21 to 1.30○

1.10 to 1.20Δ less than 1.10X

4) With respect to fogging: Judgement by visual inspection.

None ○

Acceptable Δ

Many ×

From these results, each assessment item was rated by a score, and a final judgement was made based on total scores.

Score for each assessment item

◎ five points

○ three points

Δ two points

X one point

Comprehensive assessment by total scores 17 to 18 points ◎ (very excellent)

14 to 16 points ○ (excellent)

9 to 13 points ○Δ (good: acceptable level)

7 to 8 points Δ (not suitable)

less than 6 points X (worse)

From the assessment results and the comprehensive judgement mentioned above, the two-component developing agent in Example 1 exhibited very excellent results of the toner charging amount, change in the electric resistance, printing density and fogging entirely. In the case of development at the high speed printing, a stable performance could be achieved for a long period of time with the agent in Example 1.

EXAMPLES 2 to 14

The assessment was conducted in a manner similar to Example 1 in combinations of the carriers 2 to 14 with the toner 1. FIGS. 2A through 2D illustrate results of the assessment and the comprehensive judgement together with the combination of the each carrier with the toner.

Comparative Example 1

The assessment was carried out in a manner similar to Example 1 in combination of the carrier 15 with the toner 1. FIGS. 2A and 2B illustrate assessment results and the comprehensive judgement.

Comparative Example 2

The assessment was carried out in a manner similar to Example 1 in combination of the carrier 16 with the toner 1. FIGS. 2A and 2B show assessment results and the comprehensive judgement.

EXAMPLES 15 to 27

The assessment was conducted in a manner similar to Example 1 in combinations of the carriers 17 to 29 with the toner 1. FIGS. 2C and 2D show results of the assessment and the comprehensive judgement together with the combination of the each carrier with the toner.

EXAMPLE 28

The assessment was carried out in a manner similar to Example 1 in a combination of the carrier 2 with the toner 2. FIGS. 2C and 2D show assessment results and the comprehensive judgement.

EXAMPLE 29

The assessment was carried out in a manner similar to Example 1 in a combination of the carrier 2 with the toner 3. FIGS. 2C and 2D show assessment results and the comprehensive judgement.

EXAMPLE 30

The assessment was carried out in a manner similar to Example 1 in a combination of the carrier 2 with the toner 4. FIGS. 2C and 2D illustrate assessment results and the comprehensive judgement.

EXAMPLE 31

The two-component developing agent was prepared with the carrier 11 and the toner 1 so that a concentration of the toner was 4.5 wt %. The practical printing test was conducted in a manner similar to Example 1 by means of the printing apparatus stated above in which a printing rate was changed to be 800 mm/s. FIGS. 2C and 2D show assessment results and the comprehensive judgement.

EXAMPLE 32

The two-component developing agent was prepared with the carrier 11 and the toner 1 so that a concentration of the toner was 4.5 wt %. The practical printing test was conducted in a manner similar to Example 1 by means of the printing apparatus stated above in which a printing rate was changed to be 500 mm/s. FIGS. 2C and 2D show assessment results and the comprehensive judgement.

Comparative Example 3

By using a two-component developing agent which comprises a carrier coated with silicone and which is commercially available from A company, the practical printing test was conducted with the high speed printer F6760D (manufactured by Fujitsu Limited) in which the printing rate was 1152 mm/s. FIGS. 2C and 2D show assessment results and the comprehensive judgement.

Comparative Example 4

By using a two-component developing agent which comprises a carrier coated with a silicone resin and which is commercially available from B company, the practical printing test was conducted with the high speed printer F6760D (manufactured by Fujitsu Limited) in which the printing rate was 1152 mm/s. FIGS. 2C and 2D show assessment results and the comprehensive judgement.

Next, a description will be given of an example of an image forming apparatus in which a preferred image formation can be carried out by use of the two-component developing agent according to the present invention. The two-component developing agent according to the present embodiment is not limited to a particular fixation method after development, the two-component developing agent according to the present invention is applicable to a fixation device based on heat application system with a conventional heat roll or the like. However, when the high speed printing is carried out at the speed of more than 1 m/s, for example 1 m/s to 10 m/s, it is preferable to use the flash fixation to the heat roll or the like because the flash fixation is less dependent on the thickness of the recording medium, such as a paper. As a photoconductor in this case, it is preferable to use the photoconductor comprising amorphous silicon having a high hardness to an organic photoconductor having a poor abrasion resistance from the viewpoint of the long lifetime of the apparatus.

FIG. 3 illustrates a schematic view of the image forming apparatus 1 for use in the two-component developing agent, in which the flash fixation method is adopted. For example, this apparatus 1 may be a high speed developing type with the printing speed of 1152 mm/s. The apparatus 1 comprises charging means 20, exposing means 30, developing means 40, transferring means 50, cleaning means 60, discharging means 70 and a flash fixing means 80 including a xenon flash lamp 81, all of which being arranged around the photoconductor 10 comprising amorphous silicon.

The developing means 40 comprises a developing container 41, a developing roller 43 and a stirring blade which is not shown in FIG. 3. A toner particle TO and a carrier particle CA are brought into contact each other within the developing container 41 to form a toner having a predetermined charging amount. As the two-component developing agent usable for this apparatus 1, for example, it is possible to use the developing agent comprising the carrier 16 and the toner 1 which are demonstrated in the present Examples that the two-component developing agent comprising carrier 16 and the toner 1 provides very excellent results of the toner charging amount, change in the electric resistance, printing density and fogging entirely and good printing performance can be realized for the long period of time even in the case of the high speed printing. Therefore, the above image forming apparatus provides a good image formation for the long time. It should be noted that as the toner particle, it is possible to use a color toner, in addition to the black toner.

The present invention is not limited to the specifically disclosed embodiments, and variations and modifications may be made without departing from the scope of the present invention.

The present application is based on Japanese priority application No. 2000-207557 filed on Jul. 7, 2000, the entire contents of which are hereby incorporated by references.

What is claimed is:

1. A two-component developing agent for use in electrophotography, comprising:

a carrier comprising a magnetic particle, a surface of said magnetic particle being coated with at least a resin; and an insulating toner, wherein a mean particle size of said magnetic particle is between 30 and 90 $\mu$m and an aggregation degree of said carrier is between 2 and 15%, wherein said carrier is formed by coating the surface of said magnetic particle with at least a curable silicone resin and a soluble ratio in chloroform of said curable silicone resin when cured is between 5 and 20%.

2. A two-component developing agent for use in electrophotography, comprising:

a carrier comprising a magnetic particle, a surface of said magnetic particle being coated with at least a resin; and an insulating toner, wherein a mean particle size of said magnetic particle is between 30 and 90 $\mu$m and an aggregation degree of said carrier is between 2 and 15%, wherein said carrier is formed by coating the surface of said magnetic particle with a resin including at least a conductive carbon and a curable modified silicone resin, and 70 to 95% of the surface of said magnetic particle is covered with a coating layer having a thickness of from 0.3 to 5 $\mu$m.

3. The two-component developing agent as claimed in claim 2, wherein the conductive carbon contained in said coating layer has a specific surface area of from 700 to 1500 $m^2/g$, which is determined by a BET method.

4. The two-component developing agent as claimed in claim 2, wherein a carbon content of said coating layer at a surface side thereof is greater than that at an inner side thereof.

5. The two-component developing agent as claimed in one of claims 1 and 2, wherein said magnetic particle is manganese ferrite which is expressed by $$(MnO)_x(Fe_2O_3)_y$$

where x and y are mole percents such that x+y=100 and x is in the range of from 10 to 45.

6. The two-component developing agent as claimed in one of claims 1 and 2 wherein said toner comprises a polyester resin having as a component an alkylene oxide adduct of bisphenol A as shown in the following formula:

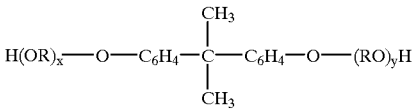

where R is ethylene or propylene group and x and y are independently integers equal to or more than 1.

7. A two-component developing agent for use in electrophotography, comprising:

a carrier comprising a magnetic particle, a surface of said magnetic particle being coated with a resin comprising at least a conductive carbon and a curable fluorine-modified silicone resin; and an insulating toner, wherein 70 to 95% of the surface of said magnetic particle is covered with a coating layer having a thickness of from 0.3 to 5 $\mu$m and a soluble ratio in chloroform of said coating layer when cured is between 5 and 20% and further wherein a mean particle size of said magnetic particle is between 30 and 90 $\mu$m and an aggregation degree of said carrier is between 2 and 15%.

8. The two-component developing agent as claimed in claim 7, wherein the conductive carbon contained in said coating layer has a specific surface area of from 700 to 1500 $m^2/g$, which is determined by a BET method.

9. The two-component developing agent as claimed in claim 7, wherein a carbon content of said coating layer at a surface side thereof is greater than that at an inner side thereof.

10. The two-component developing agent as claimed in claim 7, wherein said magnetic particle is manganese ferrite which is expressed by $$(MnO)\ x\ (Fe_2O_3)\ y$$

where x and y are mole percents such that x+y=100 and x is in a range of from 10 to 45.

11. The two-component developing agent as claimed in claim 7, wherein said toner comprises a polyester resin having as a component an alkylene oxide adduct of bisphenol A as shown in the following formula:

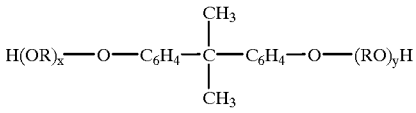

where R is ethylene or propylene group and x and y are independently integers equal to or more than 1.

12. An image forming apparatus, comprising a photoconductor, charging means, exposing means, developing means, transferring means and flash-fixing means, wherein said developing means contains a two-component developing agent comprising: a carrier comprising a magnetic particle, a surface of said magnetic particle being coated with a resin comprising at least a conductive carbon and a curable fluorine-modified silicone resin; and an insulating toner, wherein 70 to 95% of the surface of said magnetic particle is covered with a coating layer having a thickness of from 0.3 to 5 $\mu$m and a soluble ratio in chloroform of said coating layer when cured is between 5 and 20% and further wherein a mean particle size of said magnetic particle is between 30 and 90 $\mu$m and an aggregation degree of said carrier is between 2 and 15%.

13. The image forming apparatus as claimed in claim 12, wherein a printing speed of a printing sheet passed through said apparatus and printed upon is between 1 m/s and 10 m/s.

* * * * *